United States Patent [19]

Himmetsberger

[11] 4,266,803

[45] May 12, 1981

[54] SKI BRAKE

[75] Inventor: Alois Himmetsberger, Vienna, Austria

[73] Assignee: TMC Corporation, Baar, Switzerland

[21] Appl. No.: 65,688

[22] Filed: Aug. 10, 1979

[30] Foreign Application Priority Data

Aug. 16, 1978 [AT] Austria ..... 5935/78

[51] Int. Cl.[3] ..... A63C 7/10

[52] U.S. Cl. ..... 280/605; 188/5

[58] Field of Search ..... 280/605, 12 AA; 188/5, 188/8

[56] References Cited

FOREIGN PATENT DOCUMENTS

| | | | |
|---|---|---|---|
| 96661 | 7/1960 | Norway | 280/605 |
| 581478 | 11/1976 | Switzerland | 280/605 |
| 586053 | 3/1977 | Switzerland | 280/605 |

*Primary Examiner*—John J. Love
*Assistant Examiner*—D. W. Underwood
*Attorney, Agent, or Firm*—Blanchard, Flynn, Thiel, Boutell & Tanis

[57] ABSTRACT

A ski brake arrangement having a U-shaped spring wire member pivotally secured to the upper surface of a ski about an axis which extends substantially perpendicularly with respect to the longitudinal axis of the ski. Each leg of the U-shaped spring wire has a braking blade thereon. The pivotal support for the U-shaped spring wire is composed of a block having a shaft member thereon, which shaft extends parallel to the aforementioned axis and is received in an opening of a two-arm toggle lever pivotally secured to the ski about a further axis which extends parallel to the longitudinal axis of the ski. The innermost arm of the toggle lever is operatively engaged with a pedal pivotally secured to the ski so that during a downward movement of the pedal, the toggle lever will be pivoted about its pivotal support to cause an upward and inward movement of the block member. The arms of the U-shaped spring wire are received in an opening through the block so that the aforementioned movement of the block will effect an upward and inward movement of the braking blades to a fully retracted position.

4 Claims, 5 Drawing Figures

SKI BRAKE

FIELD OF THE INVENTION

The invention relates to a ski brake having at least one braking blade which is pivotally connected to a ski about an axis which is arranged substantially perpendicularly with respect to the longitudinal axis of the ski, which braking blade can be swung preferably by means of a pedal against a spring force from an operative braking position into an inoperative retracted position and can thereby move toward the central longitudinal axis of the ski.

BACKGROUND OF THE INVENTION

Such ski brakes use mostly braking blades which are arranged on both sides of the ski, and which are connected to a pedal through a U-shaped bar, and can be swung by means of the pedal from the braking position into the retracted position. In order to now effect during the swinging of the ski brake from its braking position into its retracted position a pulling in of the braking blades in a direction toward the central longitudinal axis of the ski, it has become known to mount cams on a base or bearing plate for the swivel axes of the braking blades, which swivel axes are arranged substantially perpendicularly with respect to the longitudinal axis of the ski. The U-shaped bar engages these cams shortly before reaching the fully retracted position and is moved transversely with respect to the longitudinal axis of the ski, so that the braking blades move in a direction toward the central longitudinal axis of the ski.

It has also become known to achieve, with the help of stretching devices for the U-shaped connecting bar, a pulling in of the braking blades along the length of their swivel axes.

However, these conventional constructions have not proven to be successful among others due to the high operating forces and the relatively high wear of the bearing points for the braking blades.

Therefore, the basic purpose of the invention is to provide a ski brake of the above-mentioned type, in which an effective pulling in of the braking blades is acheived, which pulling in is associated with relatively low operating forces, in direction of the central longitudinal axis of the ski during the course of the swinging from their braking position into the retracted position.

The invention provides a member which is pivotally supported for movement about an axis which extends substantially at a right angle with respect to the longitudinal axis of the ski, which member is pivotally supported about a further axis which extends substantially in longitudinal direction of the ski.

In this arrangement an extraordinarily efficient pulling in of the braking blades can be achieved.

A preferred exemplary embodiment having braking blades which are arranged on both sides of the ski and which are connected to a pedal through a U-shaped bar which is preferably formed of spring wire, is characterized by the axes which are arranged substantially perpendicularly with respect to the longitudinal axis of the ski being constructed on an arm of toggle levers, which are pivotally supported about the axes which are arranged substantially in longitudinal direction of the ski.

It is preferable if each braking blade is connected to a block, on which a shaft is constructed, which shaft is received in an opening of the toggle lever.

It is furthermore preferable if the toggle levers are pivotally supported on the ski in the region of their angled segments and wherein the pedal during swinging of the ski brake from the braking position into the retracted position loads and swivels the arms of the toggle levers, which arms extend toward the central longitudinal axis of the ski.

BRIEF DESCRIPTION OF THE DRAWINGS

The invention will be discussed in more detail hereinbelow with reference to one preferred exemplary embodiment and with reference to the figures in the drawings, without inferring any limiting meaning thereto.

DETAILED DESCRIPTION

Figures 1, 1A:
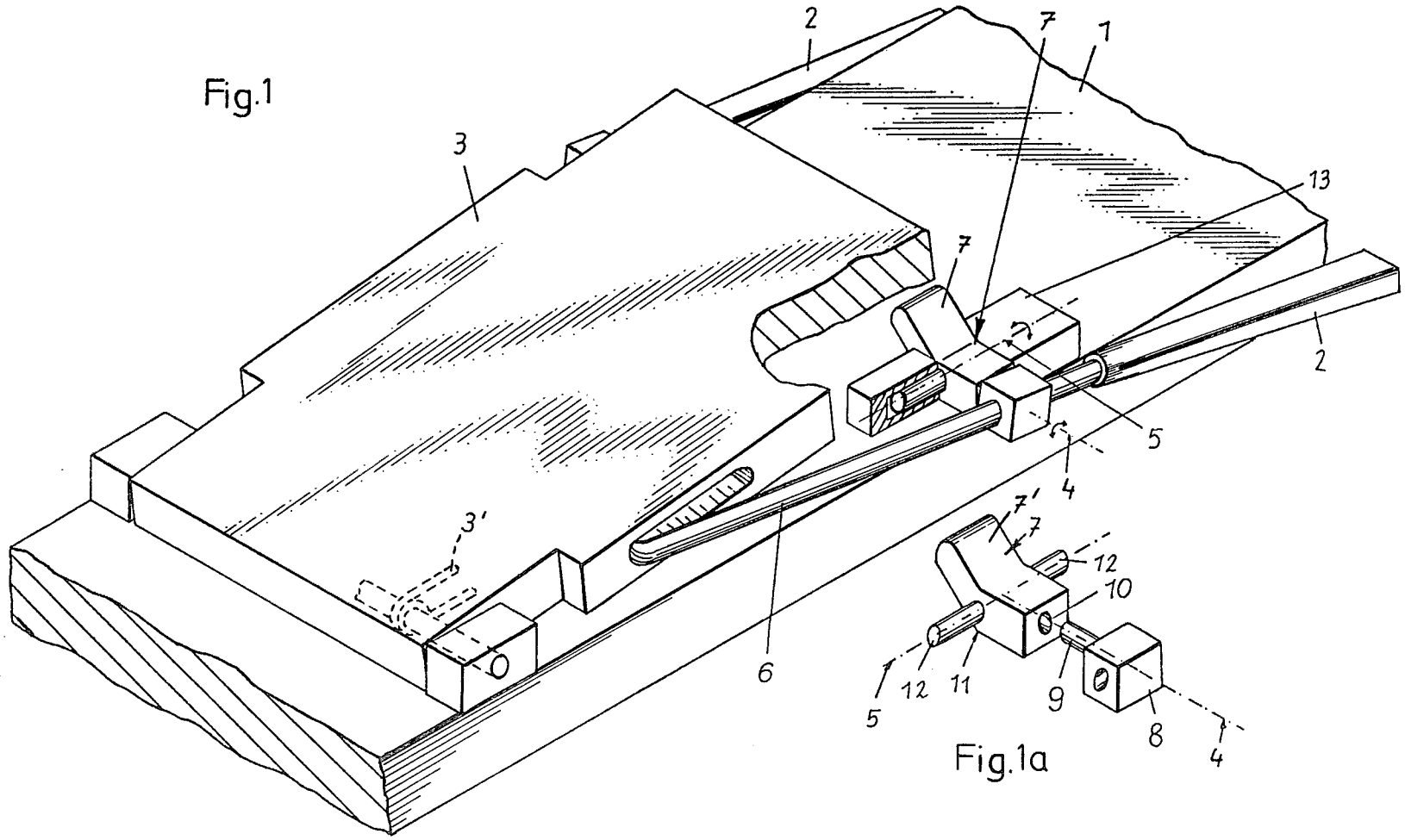
FIG. 1 is a perspective view of the inventive ski brake in a position between the retracted and the braking position.
FIG. 1*a* is a cutaway fragment of FIG. 1.

As can be seen from FIG. 1, the inventive ski brake has two braking blades 2 which are arranged on both sides of the ski 1 and which are pivotally supported about axes 4 which are arranged substantially at a right angle with respect to the longitudinal axis of the ski. The two braking blades 2 are connected to each other through a U-shaped bar 6 made of spring wire, the central bight portion of which in turn is received in a guide slot of a pedal 3 which is hingedly connected to the ski. With the help of the pedal 3, it is possible to swing the braking blades 2 from their braking into their retracted position.

To produce the erecting force of the braking blades, the pedal 3 can for example be initially biassed to an angled relation relative to the ski by a torsion spring 3' only schematically illustrated.

Each braking blade 2 has a ski-fixed bearing block 13 associated with it, in which a toggle lever 7 is pivotally supported about a further axis 5, which extends substantially in longitudinal direction of the ski. The toggle lever 7 has for its pivotal support a pair of pins 12 which extends coextensively with the axis 5. Furthermore at one end of the toggle lever 7 there is an opening 10, the axis of which is arranged substantially perpendicularly with respect to the longitudinal axis of the ski, into which opening is received the shaft 9 of a block 8. The braking blade is fixedly connected to the block 8.

Figure 2A:
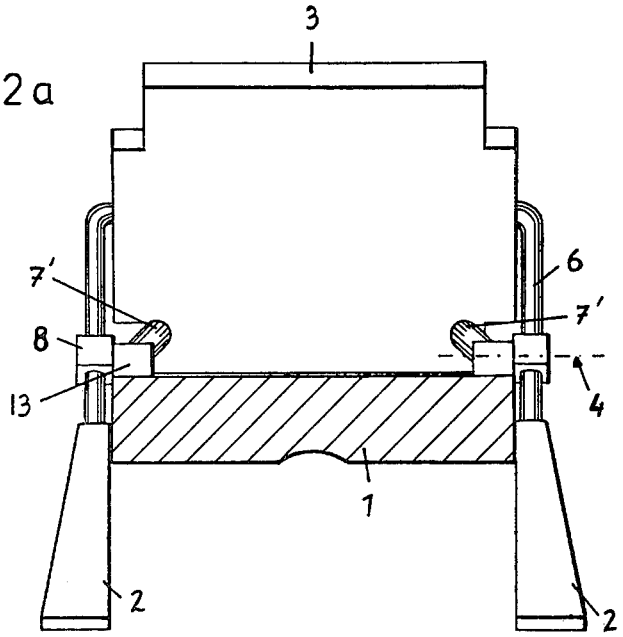
FIG. 2*a* is a rear view of the ski brake in the braking position.
Figure 2B:
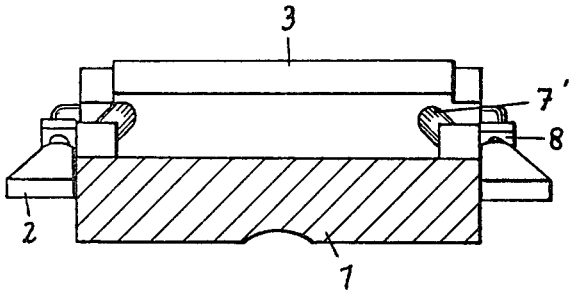
FIG. 2*b* is a rear view of the ski brake in a position between the braking and the retracted position.
Figure 2C:
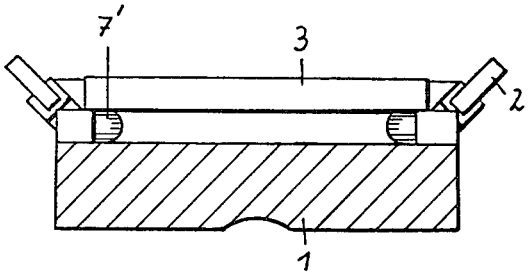
FIG. 2*c* is a rear view of the ski brake in the retracted position.

The operation will be readily apparent from FIGS. 2*a* to 2*c*. FIG. 2*a* illustrates the ski brake in braking position. The legs of the U-shaped bar 6 are lightly initially spring tensioned to the outside, so that the braking blades 2 have their largest spacing from one another. If now for example a ski boot presses down onto the pedal 3, as this is illustrated in FIG. 2*b*, then the braking blades 2 swing from their braking position in a direction toward the retracted position. Shortly before reaching the fully retracted position (FIG. 2*b*), the pedal 3 applies a force to the arms 7' of the toggle levers 7, which arms are located toward the central longitudinal axis of the ski from the axis 5, so that the toggle levers 7 are pivotal about their axes 5. As a result, the braking blades 2, which are supported on the toggle levers 7, are swivelled toward the central longitudinal axis of the ski. This movement also causes an inward flexing of the legs of the U-shaped bar 6 against the pretensioned spring force described above. FIG. 2*c* illustrates the fully retracted position of the ski brake. It can easily be seen that the braking blades can in this retracted position, for example during inclined travel, no longer create an obstacle.

Many different exemplary embodiments are possible within the scope of the invention. For example, it would be possible to support the arms 7' of the toggle levers 7 in the pedal, wherein a similar swivelling of the braking blades would be obtained.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski brake for use on a ski, comprising:

first axle means adapted to be mounted on said ski, said first axle means having a first axis extending transverse of the longitudinal axis of said ski;

pedal means pivotally secured to said first axle means and movable between a first position upwardly inclined to the upper surface of said ski and a second limit position generally parallel to said upper surface of said ski;

resilient means biasing said pedal means toward said first limit position;

at least one ski brake blade means operatively connected to said pedal means for effecting a movement thereof between a braking position when said pedal means is in said first limit position and a retracted position when said pedal means is in said second limit position and in response to a movement of said pedal means between said first and second limit positions;

second axle means secured to said ski brake blade means and having a second axis extending parallel to said first axis;

third axle means adapted to be mounted on said ski at a location longitudinally spaced from said first axle means, said third axle means having a third axle extending parallel to said longitudinal axis of said ski, said third axle means additionally having a pair of connected lever arms, each located on opposite sides of said third axis with at least one of said lever arms being positioned in the path of movement of said pedal means, said third axle means further having bearing means on one of said lever arms for rotatably supporting said second axle means for rotation about said second axis so that a movement of said pedal means from said first limit position toward said second limit position will effect an engagement of said pedal means with the other of said lever arms to cause said third axle means and said ski brake blade means to rotate in unison about said third axis.

2. The ski brake according to claim 1, wherein a pair of ski brake blade means are provided on opposite sides of said ski and are connected to each other through a U-shaped bar formed of spring wire and to said pedal means, wherein said first axis is arranged substantially at a right angle with respect to said longitudinal axis of said ski.

3. The ski brake according to claim 2, wherein said second axle means comprises a block on each said ski brake blade means, on which is constructed a shaft corresponding to said second axis, said shaft being received in an opening in each said one lever arm, which opening defines said bearing means.

4. The ski brake according to claim 2 or 3, wherein each said other lever arm extends away from said second axis toward the central longitudinal axis of said ski beneath said pedal means and, upon an engagement of said pedal means therewith, effect an upward and inward movement of each said one lever arm toward said longitudinal center axis of said ski.

* * * * *